US006817418B2

(12) United States Patent
Gatherar et al.

(10) Patent No.: US 6,817,418 B2
(45) Date of Patent: Nov. 16, 2004

(54) SUBSEA COMPLETION ANNULUS MONITORING AND BLEED DOWN SYSTEM

(75) Inventors: Nicholas Gatherar, Juniper Green (GB); Alasdair MacFarlane, Denny (GB); Gavin Reilly, Blackwood (GB)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/169,809

(22) PCT Filed: Jan. 11, 2001

(86) PCT No.: PCT/GB01/00102

§ 371 (c)(1),
(2), (4) Date: Dec. 4, 2002

(87) PCT Pub. No.: WO01/51758

PCT Pub. Date: Jul. 19, 2001

(65) Prior Publication Data

US 2003/0145999 A1 Aug. 7, 2003

(30) Foreign Application Priority Data

Jan. 14, 2000 (GB) ..... 0000876

(51) Int. Cl.[7] ..... E21B 15/02
(52) U.S. Cl. ..... 166/368; 166/339
(58) Field of Search ..... 166/368, 339, 166/345, 363, 88.1, 65.1, 75.14

(56) References Cited

U.S. PATENT DOCUMENTS

| | | | | | |
|---|---|---|---|---|---|
| 4,116,044 | A | * | 9/1978 | Garrett | 73/40.5 R |
| 4,210,208 | A | * | 7/1980 | Shanks | 166/352 |
| 4,519,263 | A | * | 5/1985 | Milberger | 74/128 |
| 4,887,672 | A | | 12/1989 | Hynes | |
| 6,053,252 | A | * | 4/2000 | Edwards | 166/348 |
| 6,227,300 | B1 | * | 5/2001 | Cunningham et al. | 166/339 |
| 6,513,596 | B2 | * | 2/2003 | Wester | 166/336 |

FOREIGN PATENT DOCUMENTS

GB 2 321 658 A 8/1998

OTHER PUBLICATIONS

International Search Report, PCT/GB01/00102, filing date Nov. 01, 2001.*

* cited by examiner

*Primary Examiner*—Frank Tsay
(74) *Attorney, Agent, or Firm*—Henry C. Query, Jr.

(57) ABSTRACT

A subsea wellhead (10) includes annulus pressure monitoring and bleed down ports (32, 34, 36) whereby excessive pressure may be detected and bled off to a production controls or workover controls system via an electro/hydraulic jumper (58). A valve block (44) bolted to the wellhead (10) includes pressure transducers (52, 54, 56) and isolation valves (46, 48, 50). Excessive annulus pressures and hence damage to the completion program may thereby be avoided in HPHT subsea well applications.

10 Claims, 2 Drawing Sheets

Fig. 2
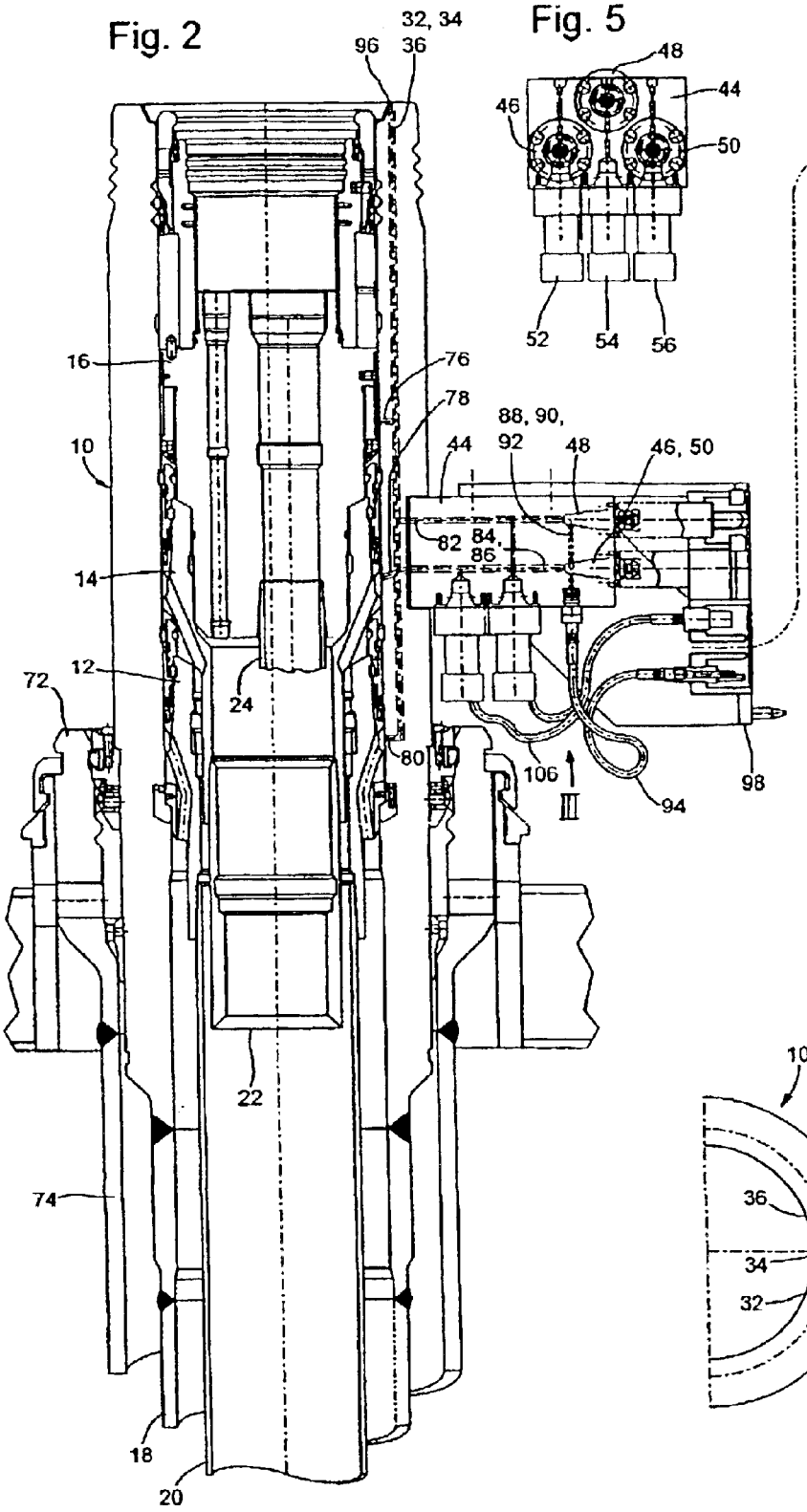
Fig. 5
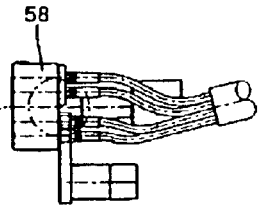
Fig. 6
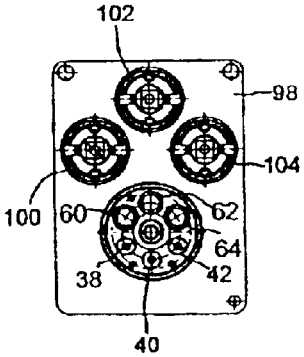
Fig. 4
Fig. 3
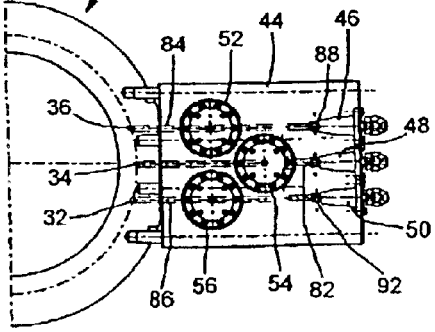

SUBSEA COMPLETION ANNULUS MONITORING AND BLEED DOWN SYSTEM

INVENTION BACKGROUND

High Pressure High Temperature (HPHT) wells necessitate a requirement to bleed down casing string annuli, to prevent thermal pressure loads from damaging the completion casing program. Thermal expansion of trapped fluid in the casing annuli could otherwise lead to excessive pressure build up causing damage to or failure of the casing completion system.

Annulus bleed down can be readily achieved on surface wellhead applications, as the wellhead housing can be provided with annulus outlets. Subsea wellheads do not have annulus outlets. Each casing string is instead suspended and sealed within the wellhead high pressure housing. No provision is made for communication between each casing string annulus and the wellhead exterior. Assuming that it would be possible to extract annulus fluid as and when required, there is the further problem of disposing of the bled off fluid in an environmentally acceptable way. With the introduction of HPHT completions into the subsea environment, there is a need for subsea wellheads that can facilitate annulus bleed downs.

SUMMARY OF THE INVENTION

According to the present invention, a subsea wellhead comprises a monitoring and/or bleed down port extending laterally through a wall of the wellhead housing and having an interior end connected to a well annulus and an exterior end connectable to a jumper for conveying pressure signals and/or expelled annulus fluid to a controls interface.

A preferred embodiment of the invention facilitates the isolation and pressure monitoring of each casing annulus, via a remotely deployable electro/hydraulic control jumper providing a link between the wellhead casing annuli and the subsea production control facility, or a workover control system, as desired. The invention may be used with particular advantage in conjunction with a drill-through horizontal Christmas tree.

The preferred embodiment makes use of three primary components.

1. A modified subsea wellhead housing containing linked annulus ports.
2. A bolt on valve block incorporating independent isolation valves, pressure monitoring equipment and an electro/hydraulic control interface. Alternatively, some or all of these components may be integrated into the wellhead itself.
3. An ROV/diver deployable electro/hydraulic control stab plate jumper to facilitate remote connection between the subsea production control system and the wellhead electro/hydraulic control interface.

Further preferred features of the invention are in the dependent claims and in the following description of an illustrative embodiment made with reference to the drawings.

BRIEF DESCRIPTION OF THE DRAWINGS

FIG. 2 is a more detailed view of the wellhead of FIG. 1;

FIG. 3 is a view on arrow III in FIG. 2;

FIG. 4 is a front view of an ROV plate of the wellhead;

FIG. 5 is a view from behind the ROV plate of FIG. 4 and

FIG. 6 shows an ROV deployed jumper.

DESCRIPTION OF THE PREFERRED EMBODIMENT

Figure 1:
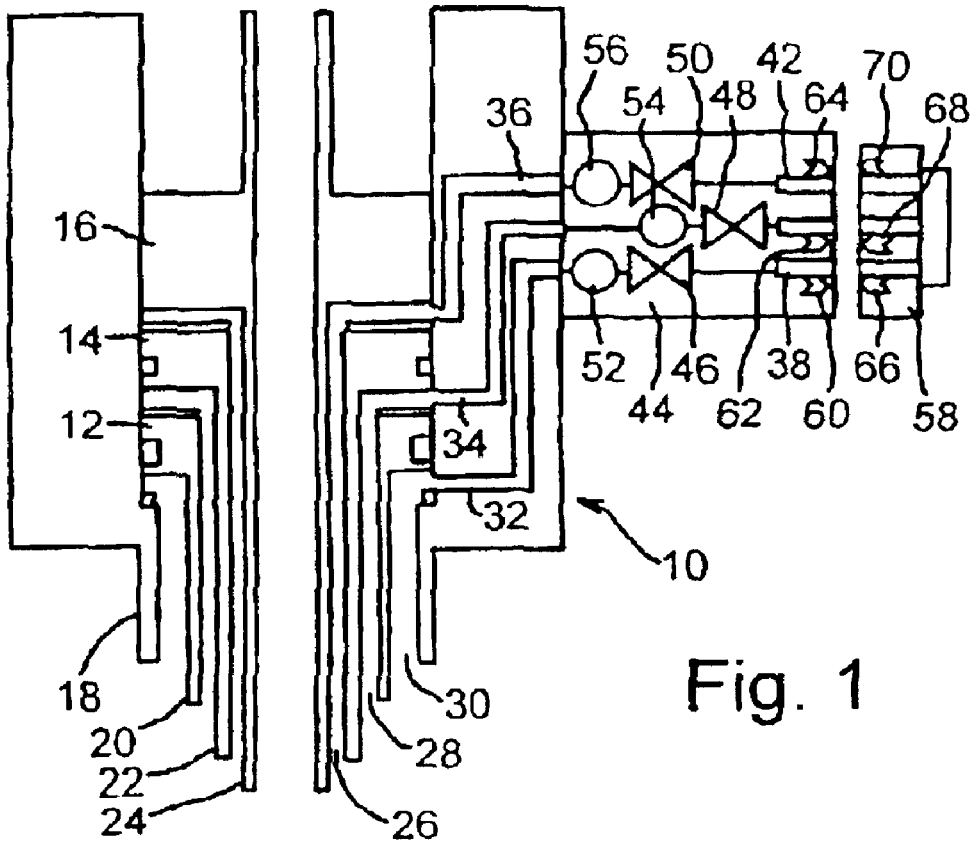
FIG. 1 is a diagrammatic representation of a wellhead embodying the present invention.

Referring to FIG. 1, there is shown a wellhead housing 10 in which is landed a first casing hanger 12, a second casing hanger 14 and a tubing hanger 16. The wellhead housing 10 is mounted on an outer casing 18 and the casing hangers 12, 14 suspend casing strings 20, 22 respectively. Tubing 24 is suspended from the tubing hanger 16. A first annulus 26 is defined between the tubing string 24 and the casing string 22; a second annulus 28 is defined between the casing strings 22, 20 and a third annulus 30 is defined between the casing string 20 and the outer casing 18. A first annulus port 32 is formed extending through the wall of the wellhead housing 10, having an inner end in communication with the space below the casing hanger 20 and hence in communication with the outermost annulus 30. A second annulus port 34 is formed extending through the wall of the wellhead housing 10, having an inner end in communication with the space defined between the casing hangers 12 and 14, and hence in communication with the production casing annulus 28. A third annulus port 36 is formed extending through the wall of the wellhead housing 10, having an inner end in communication with the space defined between the tubing hanger 16 and the production casing hanger 14, and hence in communication with the tubing annulus 26.

The outer ends of the annulus ports 32, 34, 36 are connected to hydraulic couplers 38, 40, 42 contained in a valve block 44 bolted to the wellhead 10. Each annulus port connection within the valve block 44 is controlled by a respective ROV or diver operable isolation valve 46, 48, 50 and is equipped with a pressure transducer 52, 54, 56. An ROV/diver deployable electro-hydraulic jumper 58 is connectable to the valve block 44 to convey expelled annulus fluid from the hydraulic couplers 38, 40, 42 to a production controls system or workover controls system (not shown), as appropriate. Electrical couplers 60, 62, 64 are provided in the valve block 44 and mate with corresponding jumper connectors 66, 68, 70 for conveying pressure signals to the production or workover controls system. When the pressure reading from one of the transducers 52, 54, 56 exceeds a critical value, the corresponding valve 46, 48, 50 can be opened, allowing annulus fluid to be vented or bled off into the production or workover controls system, so reducing the annulus pressure and avoiding damage to the casing completion program. During well drilling operations, the jumper 58 can be disconnected and replaced by a protective cap.

FIGS. 2–6 show the wellhead 10, valve block 44 and jumper 58 in more detail. The wellhead housing 10 is supported in a conductor housing 72 welded to the upper end of a conductor casing 74 surrounding the outer casing 18. The annulus ports 32, 34, 36 are drilled vertically downwardly through the wall of the housing 10 from its upper surface 96, at circumferentially spaced locations. The upper ends of the vertical drillings are then plugged. Radial drillings 76, 78, 80 provide communication between the wellhead interior and the respective vertical drillings, at the correct vertical locations for communication with the respective casing/tubing annuli. Further horizontal drillings 82, 84, 86 in the valve block 44 and wellhead housing 10 communicate between the vertical drillings and the valves 46, 48, 50. The pressure transducers also communicate with the horizontal drillings 82, 84, 86. An ROV plate 98 (FIG.

4) is mounted to one end of the valve block 44 and contains ROV receptacles 100, 102, 104 for actuation of the valves 46, 48, 50. Vertical drillings 88, 90, 92 lead from the valves 46, 48, 50 and are connected to the hydraulic couplers 38, 40, 42 mounted on the ROV panel, by hoses 94. Electrical wet-mate connectors 62, 64, 66 on the ROV panel 98 are connected to the pressure transducers 52, 54, 56 by cables 106. The electro/hydraulic jumper has corresponding hydraulic and electrical couplers arranged to mate with those in the ROV panel 98 in use.

What is claimed is:

1. A subsea wellhead comprising at least one port extending completely through a side wall of the wellhead and having an interior end connected to a well annulus and an exterior end removably connectable to a jumper which in turn is connected to a controls system; wherein pressure signals and/or expelled annulus fluid may be conveyed from the well annulus to the controls system.

2. A wellhead as defined in claim 1, further comprising an isolation valve for controlling flow through the port.

3. A wellhead as defined in claim 2, wherein the isolation valve is disposed in a valve block attached to the wellhead.

4. A wellhead as defined in claim 3, wherein the valve block comprise an ROV panel.

5. A wellhead as defined in claim 4, wherein the ROV panel comprises a receptacle for actuation of the isolation valve.

6. A wellhead as defined in claim 1, further comprising a pressure transducer in communication with the port.

7. A wellhead as defined in claim 6, wherein a signal from the pressure transducer is conveyed to the controls system via the jumper.

8. A wellhead as defined in claim 4, wherein the ROV panel comprises a number of electrical and/or hydraulic couplers for connection to the jumper.

9. In combination with a wellhead as defined in claim 1, a horizontal Christmas tree which is mounted on the wellhead.

10. A wellhead as defined in claim 9, wherein the horizontal Christmas tree is a drill-through horizontal Christmas tree.

* * * * *